US010495392B2

(12) United States Patent
Garner et al.

(10) Patent No.: US 10,495,392 B2
(45) Date of Patent: Dec. 3, 2019

(54) COOLER, COOLER PLATFORM ASSEMBLY, AND PROCESS OF ADJUSTING A COOLER PLATFORM

(75) Inventors: Michael Garner, Houston, TX (US); Jesse Hines, Broken Arrow, OK (US); Charles Bowers, Claremore, OK (US); Ben Cole, Catoosa, OK (US); Richard Kelsey, Claremore, OK (US); Michael Shroyer, Skiatook, OK (US); Tracy Mabes, Tulsa, OK (US)

(73) Assignee: E&C Finfan, Inc., Ball Ground, GA (US)

( * ) Notice: Subject to any disclaimer, the term of this patent is extended or adjusted under 35 U.S.C. 154(b) by 1959 days.

(21) Appl. No.: 13/542,947

(22) Filed: Jul. 6, 2012

(65) Prior Publication Data

US 2013/0012118 A1 Jan. 10, 2013

Related U.S. Application Data

(60) Provisional application No. 61/505,459, filed on Jul. 7, 2011.

(51) Int. Cl.
*F28F 27/00* (2006.01)
*E04G 3/20* (2006.01)
*E04G 1/15* (2006.01)

(52) U.S. Cl.
CPC ..... *F28F 27/003* (2013.01); *E04G 1/15* (2013.01); *E04G 3/20* (2013.01); *F28F 2280/00* (2013.01)

(58) Field of Classification Search
CPC ..... F24F 2013/205; F24F 2280/105; F24F 2280/10; F24F 2265/00; E04G 1/362; E04G 11/082; E04G 2001/157; E04G 3/20
USPC ..... 454/338; 52/656.8, 762, 764; 165/900, 165/104.28; 261/155, 156, 150, 128; 182/12–14, 17, 62.5, 222, 223, 83
See application file for complete search history.

(56) References Cited

U.S. PATENT DOCUMENTS 2,583,592 A * 1/1952 Pogue ..... B65D 88/34 182/82
2,616,565 A * 11/1952 Morgan ..... C02F 3/28 210/195.1

(Continued)

OTHER PUBLICATIONS

Harsco Industrial Air_X_changers Oct. 11 2003 Harsco Industrial Air_X_changers Oct. 26, 2006 Harsco Industrial Air_X_changers Nov. 3, 2010 Manufacturer Literature, Model EH, and Manufacturer website Archive.org.*

(Continued)

*Primary Examiner* — Edelmira Bosques
*Assistant Examiner* — Frances F. Hamilton
(74) *Attorney, Agent, or Firm* — Cook Alex Ltd.; R. Blake Johnston

(57) ABSTRACT

A cooler, a cooler platform assembly, and a process of adjusting a cooler platform are disclosed. The cooler includes a cooling region, a discharge region, and a cooler platform positioned in the discharge region and proximal to a sloped interior section of the cooler. The cooler platform assembly includes a cooler platform, a sloped interior section of a cooler proximal to a first end of the cooler platform, and a vertical wall proximal to a second end of the cooler platform. The process includes adjusting a cooler platform from a retracted position substantially parallel to a vertical wall of a cooler to a deployed position substantially perpendicular to the vertical wall.

16 Claims, 4 Drawing Sheets

(56) References Cited

U.S. PATENT DOCUMENTS 2,918,985 A * 12/1959 Rizzuto ..... E06C 1/39 182/120
3,063,688 A * 11/1962 Fordyce ..... F28F 25/082 182/194
3,165,455 A * 1/1965 Rose ..... B01D 5/0012 202/189
3,519,068 A * 7/1970 Billington ..... F28B 1/06 165/68
3,850,596 A * 11/1974 Fisher ..... B01D 46/02 182/222
3,892,088 A * 7/1975 Fleenor ..... B60P 1/003 49/37
3,976,127 A * 8/1976 Harris ..... F28B 1/06 165/125
4,036,916 A * 7/1977 Agsten ..... F03D 1/04 261/109
4,045,193 A * 8/1977 Halliday ..... F28C 1/02 96/356
4,090,585 A * 5/1978 Laub ..... A62B 5/00 182/113
4,222,140 A * 9/1980 Olewinski ..... E01D 15/24 14/71.3
4,261,714 A * 4/1981 Peterson ..... B01D 46/0005 55/302
4,280,243 A * 7/1981 Durrant ..... B65G 69/2835 14/71.1
4,416,836 A * 11/1983 Sinek ..... F28C 1/02 261/112.1
4,521,231 A * 6/1985 Shilling ..... B01D 46/04 55/302
4,530,804 A * 7/1985 Cates ..... F28C 1/04 261/30
4,607,994 A * 8/1986 Jacobsson ..... F27D 1/1621 182/128
4,679,657 A * 7/1987 Bennett ..... B65G 69/22 182/1
4,755,331 A * 7/1988 Merrill ..... F28D 5/02 165/172
4,776,429 A * 10/1988 Osborn ..... B65G 69/22 182/144
4,957,276 A * 9/1990 Garrish ..... F28C 1/02 261/112.1
5,008,967 A * 4/1991 Barrios ..... E01F 9/696 14/7
5,232,636 A * 8/1993 Cates ..... F28F 25/02 261/111
5,311,966 A * 5/1994 Daniels ..... B61D 49/00 182/128
5,328,600 A * 7/1994 Cates ..... F28F 25/02 137/68.11
5,671,823 A * 9/1997 Oakes ..... B66F 11/04 182/113
5,724,828 A * 3/1998 Korenic ..... F28C 1/14 165/900
5,845,743 A * 12/1998 Dechant ..... E04G 3/20 182/187
5,851,446 A * 12/1998 Bardo ..... E04H 5/12 261/111
6,102,157 A * 8/2000 Goldbach ..... B05B 13/005 182/128
6,135,526 A * 10/2000 Reckner, Jr. ..... B60P 3/36 182/127
6,170,216 B1 * 1/2001 Rye ..... B29C 45/2628 52/656.8
6,516,892 B2 * 2/2003 Reilly ..... E21B 19/22 166/384
6,564,904 B2 * 5/2003 Mueller ..... B05B 16/40 182/222
7,320,374 B2 * 1/2008 Folk ..... E21B 19/02 175/220
7,600,743 B2 * 10/2009 Dorin ..... F28B 1/06 165/60
8,235,363 B2 * 8/2012 Samyn ..... F28B 1/06 165/47
8,333,046 B2 * 12/2012 Hedegaard ..... E04G 3/24 52/645
8,365,472 B2 * 2/2013 Grimaldi ..... B63B 17/04 114/362
8,456,840 B1 * 6/2013 Clidaras ..... H05K 7/20745 165/104.22
8,615,965 B2 * 12/2013 Kryger ..... E04H 7/22 52/123.1
8,733,034 B2 * 5/2014 Ballester ..... B65G 69/001 14/71.5
9,016,065 B2 * 4/2015 Bezat ..... F02C 7/047 60/730
2002/0076289 A1 * 6/2002 Al-Kaabi ..... B60P 7/12 410/47
2003/0111322 A1 * 6/2003 Luevano ..... B65G 13/12 198/592
2006/0163001 A1 * 7/2006 Pozell ..... E04G 3/20 182/82
2009/0053013 A1 * 2/2009 Maltby ..... E21B 19/15 414/22.61
2009/0084523 A1 * 4/2009 Cargill ..... C13B 30/00 165/92
2009/0183947 A1 * 7/2009 Hudgens-Wallace ..... E04G 3/18 182/150
2009/0229915 A1 * 9/2009 Durkin ..... E06C 9/02 182/93
2010/0091449 A1 * 4/2010 Clidaras ..... G06F 1/20 361/679.49
2010/0307868 A1 * 12/2010 Bennett ..... B61K 13/00 182/36
2012/0006619 A1 * 1/2012 DuBose ..... B60P 1/00 182/113
2012/0147558 A1 * 6/2012 Dunn, Jr. ..... H05K 7/1497 361/688
2013/0000231 A1 * 1/2013 Greaves ..... E04D 13/12 52/183
2013/0092352 A1 * 4/2013 Martin ..... F28F 9/00 165/68
2018/0017279 A1 * 1/2018 Vanberg ..... F24D 19/10
2019/0257096 A1 * 8/2019 Caskey ..... E04G 3/243

OTHER PUBLICATIONS

Harsco Industrial Air-x-changers , model F, Nov. 10, 2010.*

* cited by examiner

COOLER, COOLER PLATFORM ASSEMBLY, AND PROCESS OF ADJUSTING A COOLER PLATFORM

FIELD OF THE INVENTION

The present invention is directed to cooling systems, coolers, and cooler system components. More particularly, the present invention is directed to coolers having internal structural components and process of adjusting internal structural components.

BACKGROUND OF THE INVENTION

Commercial cooling systems can include coolers that are very large. These coolers can be as much as 200 inches in height. Vertical discharge coolers include an open region or discharge region proximal to the top of the coolers. Maintenance, repair, and cleaning of the discharge region can be difficult due to the height.

Ladders and harnesses can be used for maintenance, repair, and cleaning of the coolers. However, use of ladders and harnesses can provide limited mobility, especially within the discharge region, and can provide safety hazards.

Platform assemblies can be used for maintenance, repair, and cleaning of the coolers. However, known platform assemblies are assembled on-site, welded to the cooler structures, and extend around the outside of the cooler structures, thereby making maintenance, repair, and cleaning of the discharge region difficult and/or unsafe.

Platform assemblies have not traditionally been placed within coolers because the platform could adversely affect operation of the cooler by interfering with the discharge of air, thereby decreasing the efficiency of the cooler.

A cooler, cooler platform assembly, and a process of adjusting a cooler platform that do not suffer from one or more of the above drawbacks would be desirable in the art.

BRIEF DESCRIPTION OF THE INVENTION

In an exemplary embodiment, a cooler includes a cooling region defined by a fan support wall, a first wall, a second wall, and a sloped interior section, the sloped interior section extending between the first wall and the second wall and sloping away from the fan support wall, a discharge region defined by the first wall, the second wall, the sloped interior section, and a vertical wall, the vertical wall being substantially parallel to the fan support wall, and a cooler platform positioned in the discharge region and proximal to the sloped interior section.

In another exemplary embodiment, a cooler platform assembly includes a cooler platform, a sloped interior section of a cooler proximal to a first end of the cooler platform, and a vertical wall proximal to a second end of the cooler platform.

In another exemplary embodiment, a process of adjusting a cooler platform includes providing a cooler platform assembly, the cooler platform assembly comprising the cooler platform, a sloped interior section of a cooler proximal to a first end of the cooler platform, and a vertical wall proximal to a second end of the cooler platform, and adjusting the cooler platform from a retracted position substantially parallel to the vertical wall to a deployed position substantially perpendicular to the vertical wall.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a cooler, a cooler platform assembly, and a process of adjusting a cooler platform. Embodiments of the disclosure permit simpler and/or safer maintenance, repair, and cleaning of a discharge region of a cooler, permit mobility during maintenance, repair, and cleaning of a discharge region of a cooler, permit assembly of a platform assembly in a cooler at a manufacturing site instead of an operational site, maintain efficient operational characteristics of a cooler, protect internal components of a cooler, and combinations thereof.

Figure 1:
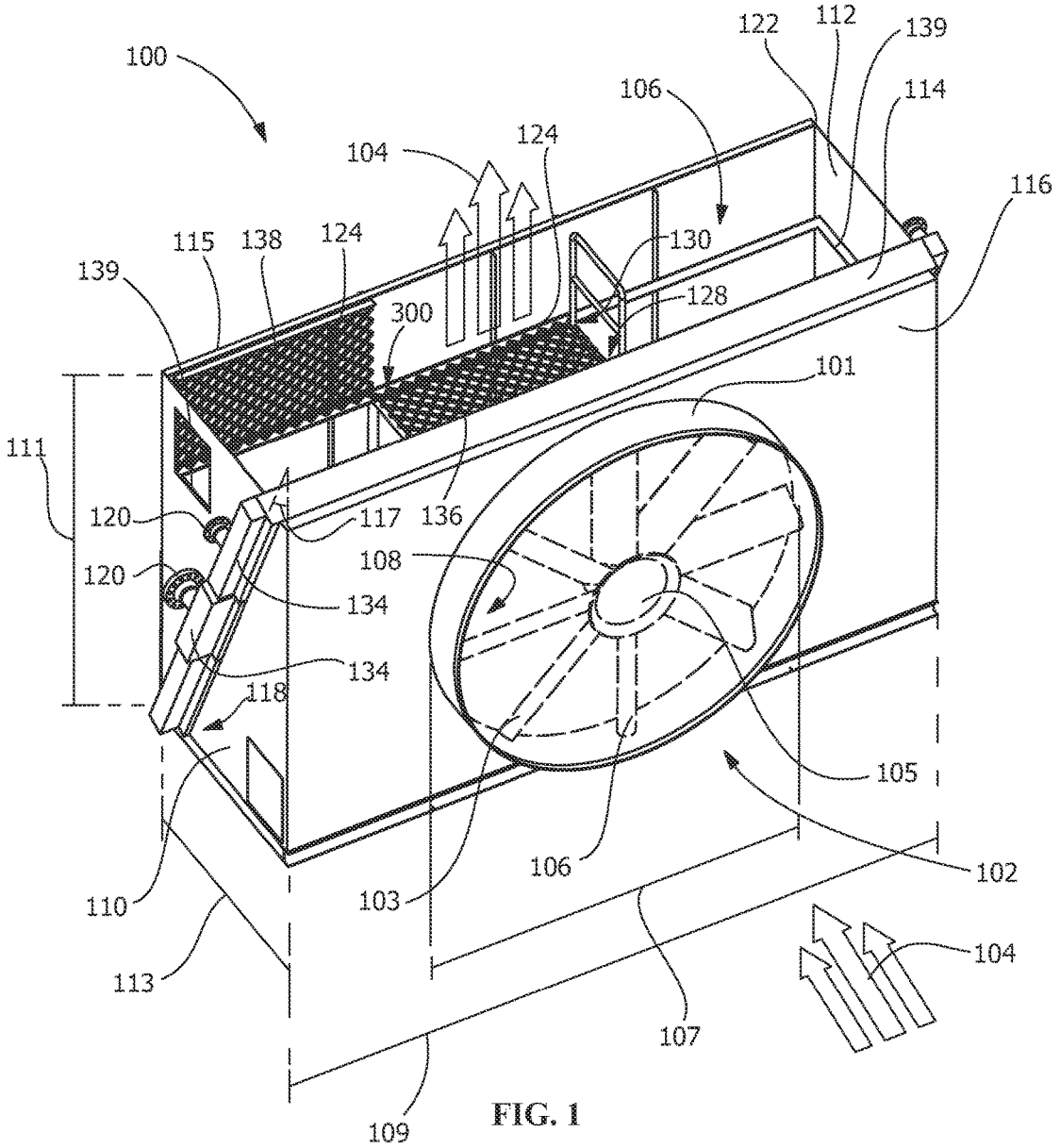
FIG. 1 is a perspective view of an exemplary cooler showing a fan and a vertical discharge region according to the disclosure.

FIG. 1 shows an exemplary embodiment of a cooler 100, such as a vertical discharge cooler. The cooler 100 is a part of or operable with any suitable cooling system. For example, in one embodiment, the cooling system is operable with an electric motor, is a part of a gas compression system, is engine-driven or electric-motor-driven, or combinations thereof. In one embodiment, the cooler 100 provides compression between about 100 HP and about 2,500 HP or between about 250 HP and about 4,500 HP, for example, as in a multi-stage cooler.

The cooler 100 includes a fan 102, such as a forced-draft fan or an induced-draft fan. In one embodiment, the cooler 100 includes a plurality of the fans 102. The fan 102 includes a plurality of blades 103 extending radially about a hub 105. In one embodiment, the fan 102 includes eight of the blades 103. The fan 102 includes a predetermined diameter 107, for example, about 24 inches, about 32 inches, about 36 inches, about 42 inches, about 48 inches, about 54 inches, about 60 inches, about 72 inches, about 81 inches, about 84 inches, about 93 inches, about 96 inches, about 108 inches, about 120 inches, about 132 inches, about 144 inches, about 156 inches, about 168 inches, or above any one of the predetermined diameters 107.

The fan 102 is positioned within a fan support wall 116, such as a vertical wall with an aperture for the fan 102. The fan support wall 116 extends a predetermined length 109, for example, about 28 inches, about 40 inches, about 52 inches, about 64 inches, about 88 inches, about 100 inches, about 112 inches, about 124 inches, about 136 inches, about 160 inches, about 184 inches, about 208 inches, about 232 inches, about 256 inches, about 280 inches, about 304 inches, about 328 inches, or above any of the predetermined lengths 109. The fan support wall 116 extends a predetermined height 111, for example, about 32 inches, about 41 inches, about 46 inches, about 59 inches, about 66 inches, about 80 inches, about 84 inches, about 93 inches, about 103 inches, about 104 inches, about 115 inches, about 122 inches, about 133 inches, about 136 inches, about 147 inches, about 158 inches, about 169 inches, about 172 inches, about 178 inches, about 186 inches, about 197 inches, or above any of the predetermined heights 111.

The fan 102 draws in a gaseous fluid 104, such as air, gas, engine exhaust, combustion exhaust, turbine exhaust, any other suitable cooling fluid, or combinations thereof, through a fan support structure 101 extending from the fan support wall 116. The fan 102 draws the gaseous fluid 104 into a cooling region 108 defined by the fan support wall 116, a first wall 110, a second wall 112, and a sloped interior section 114. In one embodiment, the first wall 110 and the second wall 112 are parallel to each other, perpendicular to the fan support wall 116, and extend to substantially the predetermined height 111 of the fan support wall 116. The first wall 110 and the second wall 112 each extend from the fan support wall 116 to a vertical wall 115 opposite the fan support wall 116 at a predetermined depth 113, for example, about 33 inches, about 36 inches, about 39 inches, about 44 inches, about 47 inches, about 52 inches, about 54 inches, about 58 inches, about 64 inches, about 69 inches, about 73 inches, about 76 inches, about 80 inches, about 84 inches, about 88 inches, about 90 inches, about 93 inches, about 94 inches, about 96 inches, about 100 inches, about 108 inches, about 113 inches, or above any of the predetermined widths 113.

Referring again to FIG. 1, the sloped interior section 114 extends between the first wall 110 and the second wall 112 sloping away from the fan support wall 116 as it extends toward a lower portion 118 in a direction opposite a discharge region 106 at a predetermined angle 117, for example, about 10 degrees, about 20 degrees, about 30 degrees, about 45 degrees, greater than about 10 degrees, greater than about 20 degrees, greater than about 30 degrees, between about 10 degrees and 45 degrees, between about 20 degrees and about 45 degrees, between about 30 degrees and about 45 degrees, between about 20 degrees and about 30 degrees, or any combination or sub-combination thereof. In one embodiment, the sloped interior section 114 is positioned to create a center of gravity proximal to the center of the cooler 100. The sloped interior section 114 includes one or more sections 134, and each one or more section 134 includes one or more piping connections 120.

The sloped interior section 114 includes any suitable features for transporting, compressing, and/or cooling the gaseous fluid 104. For example, in one embodiment, the sloped interior section 114 includes flow control features (not shown), such as adjustable shutters, fixed turning vanes, and combinations thereof. Additionally or alternatively, in one embodiment, the sloped interior section 114, the lower portion 118 opposite the fan support wall 116, and/or the discharge region 106 include features or components susceptible to damage, for example, by environmental hazards such as hail, rain, ice, airborne debris, particulate, other substances encountered during transportation or operation, or combinations thereof.

The gaseous fluid 104 provides cooling then is vertically expelled through the discharge region 106 of the cooler 100. The discharge region 106 is defined by the first wall 110, the second wall 112, the sloped interior section 114, and the vertical wall 115. The vertical wall 115 is substantially parallel to the fan support wall 116. The vertical wall 115, the first wall 110, the fan support wall 116, and the second wall 112 extend in a substantially rectilinear arrangement to form a cooling structure 122 having a predetermined footprint that, in one embodiment, is not expanded by including a cooler platform 124.

The cooler platform 124 is positioned in the discharge region 106 and has a first end 128 proximal to the sloped interior section 114 and a second end 130 proximal to the vertical wall 115. The cooler platform 124 is any suitable material. In one embodiment, the cooler platform 124 comprises grate 136 and 138, for example, including steel or aluminum. In this embodiment, the grate 136 and 138 permits an individual to stand on the cooler platform 124, permits an individual to look below the discharge region 106 into the cooler 100, permits an individual to repair, maintain, or clean the discharge region 106 of the cooler 100, permits a solid material to be supported during transportation or other period thereby providing protection of interior components (not shown) of the cooler 100, or combinations thereof. In one embodiment, the cooler platform 124 is a solid material. In this embodiment, the solid material permits protection of interior components (not shown) of the cooler 100, for example, during transportation or in the environment, permits an individual to stand on the cooler platform 124, permits an individual to repair, maintain, or clean the discharge region 106 of the cooler 100, or combinations thereof. In other embodiments, the cooler platform 124 provides protection otherwise provided by a hailguard, a bug screen, a lint screen, a covering for protection during transportation of the cooler 100, or combinations thereof.

Figure 2:
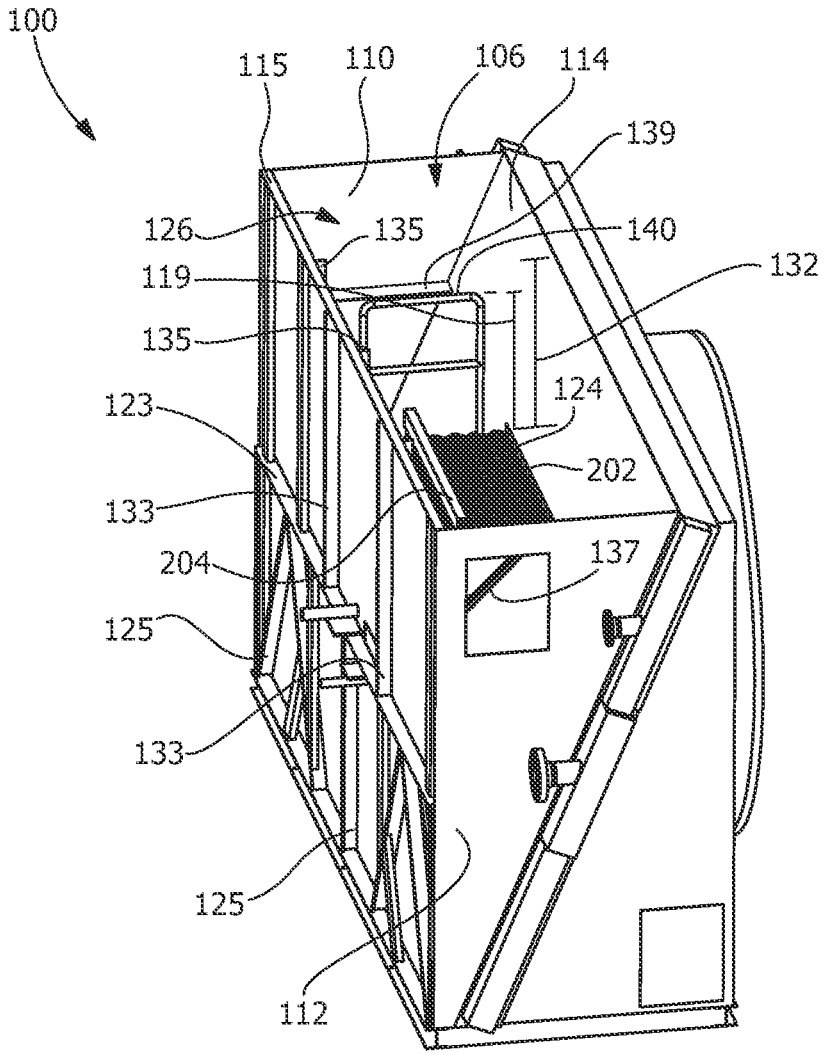
FIG. 2 is a perspective view of an exemplary cooler platform assembly formed by a cooler platform, a vertical wall, and a sloping wall according to the disclosure.

Referring to FIG. 2, one or more of the cooler platforms 124, the vertical wall 115, and the sloped interior section 114 form a cooler platform assembly 126. In a further embodiment, the cooler platform assembly 126 includes a rail 140. The sloped interior section 114 and the vertical wall 115 provide safety that would otherwise be provided by an additional railing. In one embodiment, the first wall 110, the second wall 112, or both provide safety that would otherwise be provided by an additional railing. In a further embodiment, the cooling platform assembly 126 is devoid of the rail 140. In one embodiment, the cooler platform 124 of the cooler platform assembly 126 is positioned at a depth 132 within the discharge region 106 of the cooler 100 such that the vertical wall 115 and the sloped interior section 114 at least extend a predetermined railing height 119 from the cooler platform 124, for example, at least 36 inches from the cooler platform 124, at least 48 inches from the cooler platform 124, a height required for railings by the U.S. Occupational Safety and Health Administration, a height that is smaller than the depth 132, a height of the railing 140, or combinations thereof.

In one embodiment, the cooler platform 124 is adjustable from being a deployed cooler platform 202 that is substantially perpendicular to the vertical wall 115 to a retracted cooler platform 204 that is substantially parallel to the vertical wall 115. As will be appreciated, features associated with the cooler platform 124 in the deployed position are also present in embodiments with the cooler platform 124 being fixedly secured in a deployed position within the discharge region 106, for example, with the cooler platform 124 being fixedly secured proximal to the sloped interior section 114, fixedly secured to the sloped interior section 114, or fixedly secured while in contact with the sloped interior section 114.

Figure 3:
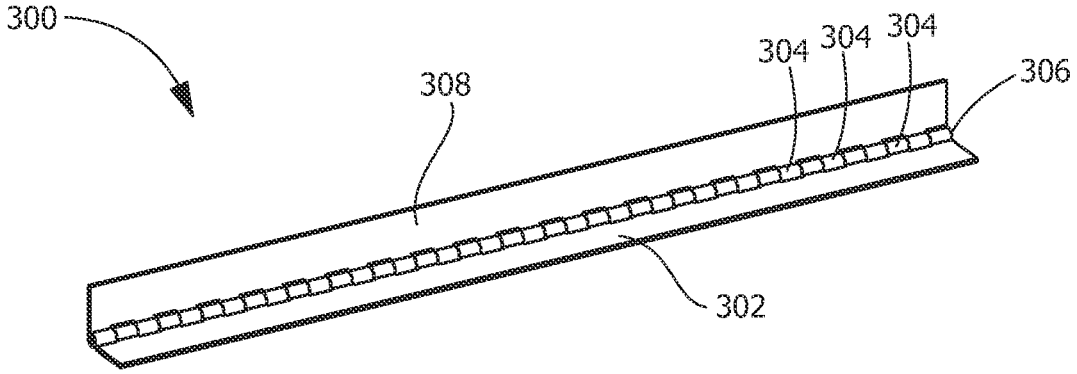
FIG. 3 is a perspective view of a piano hinge for an exemplary cooler platform assembly according to the disclosure.

The adjustability from a refracted position to a deployed position is provided by any suitable mechanism. For example, referring to FIG. 3, in one embodiment, the adjustability is provided by a piano hinge 300 securing the cooler platform 124 (see FIG. 1) to the vertical wall 115 proximal to the second end 130 (see FIG. 1) of the cooler platform 124 (see FIG. 1). The piano hinge 300 includes a platform engagement portion 302 for being secured to the cooler platform 124 by any suitable fasteners, such as, bolts, welding, interlocking features, or combinations thereof. The piano hinge 300 further includes rod engagement features 304 configured to extend around a rod 306 that serves as a fulcrum with a vertical wall engagement portion 308. In one embodiment, the rod engagement features 304 and/or the rod 306 include support features (not shown) limiting the range of movement for the cooler platform 124, for example, to about 90 degrees between refracted and deployed positions or less than about 90 degrees between the refracted and deployed positions.

The vertical wall engagement portion 308 is secured to the vertical wall 115 (see FIG. 1), by any suitable fasteners, such as, bolts, welding, interlocking features, or combinations thereof, thereby permitting adjustable deployment and retraction of the cooler platform 124, in further embodiments, the cooler platform assembly 126 includes vertical adjustment and/or horizontal adjustment capability, for example, by including features that permit sliding of the cooler platform 124, the platform engagement portion 302, the rod engagement features 304, the vertical wall engagement feature 308, other structural components of the cooler platform assembly 126, or combinations thereof.

Referring again to FIG. 2, the cooler platform assembly 126 includes structural components, such as a horizontal member 123, one or more support members 125, one or more vertical members 133, one or more internal members 135, one or more diagonal braces 137, one or more cooler platform support members 139, or combinations thereof. One or more of the structural components are positioned in the discharge region 106 and support an individual on the cooler platform 124. The structural components extend from the vertical wall 115, the horizontal member 123, the first wall 110, the second wall 112, or combinations thereof. The horizontal member 123 extends along the length of the vertical wall 115 and is supported by the support members 125. The vertical members 133 extend along the vertical wall 115 along its exterior aligned with the internal members 135 between cooler platforms 124. Within the discharge region 106, the internal members 135 extend along a portion of the vertical members 133, providing support to the cooler platform 124 through the diagonal braces 137 extending from them. In one embodiment, the diagonal braces 137 provide support to the cooler platform 124 independent from the sloped interior section 114. In another embodiment, the diagonal braces 137 provide support to the cooler platform 124 along with the sloped interior section 114. In this embodiment, the cooler platform 124 and the sloped interior section 114 contact each other when the cooler platform 124 is deployed. In one embodiment, the structural components further include the cooler platform support members 139 (see also FIG. 1) positioned horizontally along the first wall 110 and the second wall 112.

Figure 4:
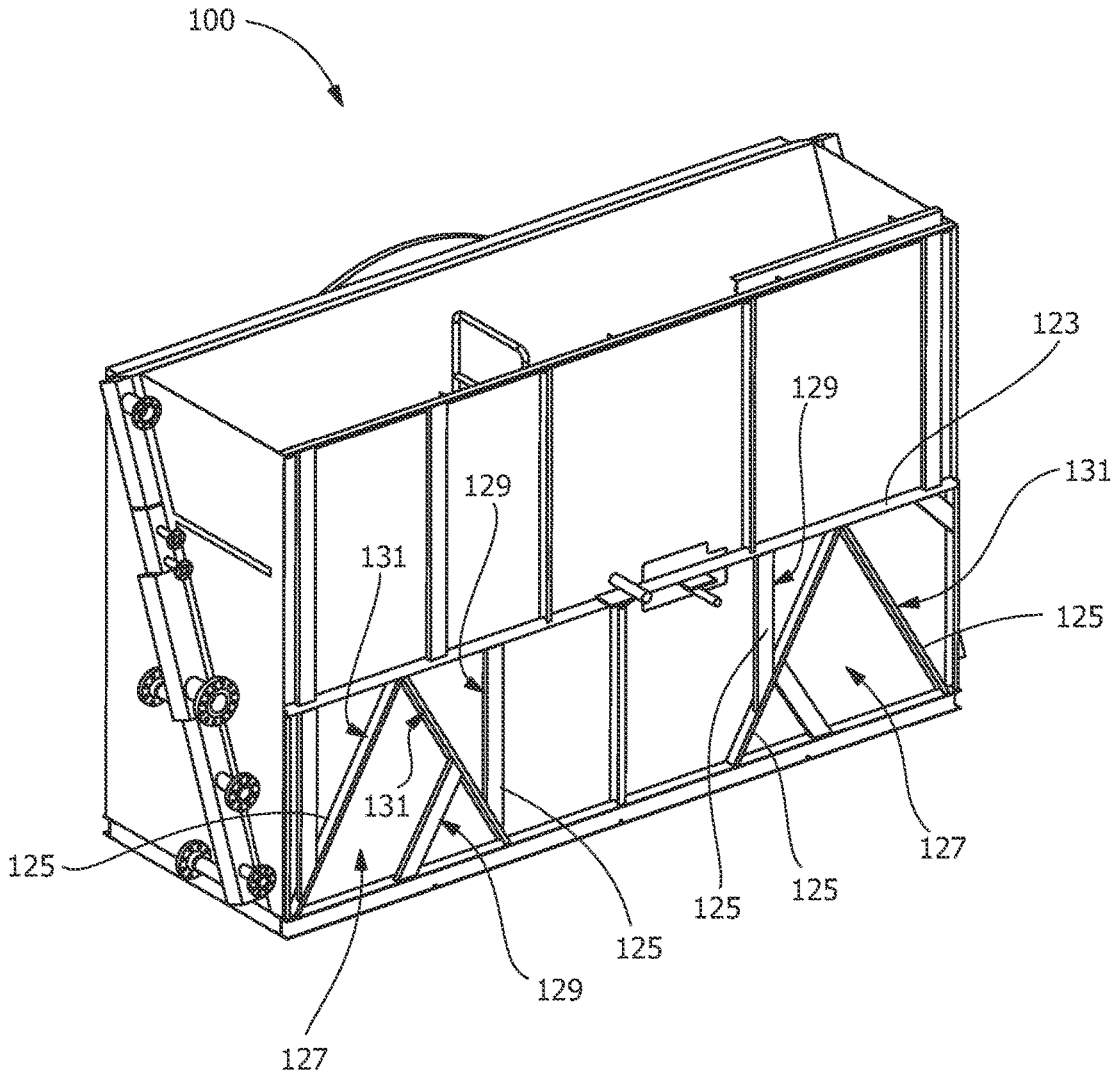
FIG. 4 is a perspective view of an exemplary cooler showing a vertical wall and a vertical discharge region according to the disclosure.

Referring to FIG. 4, in one embodiment, the support members 125 are arranged with angled and vertical orientations, thereby providing additional support based upon their combined geometry. For example, in one embodiment, the support members 125 form one or more triangles 127, thereby distributing weight of the horizontal member 123. In a further embodiment, one or more of the support members 125 extend from the one or more triangles 127, providing further structural support. In another embodiment, the support members 125 are arranged with wider portions 129 abutting the vertical wall 115 on some of the support members 125 and narrower portions 131 abutting the vertical wall 115 on others of the support members 125.

Figure 5:
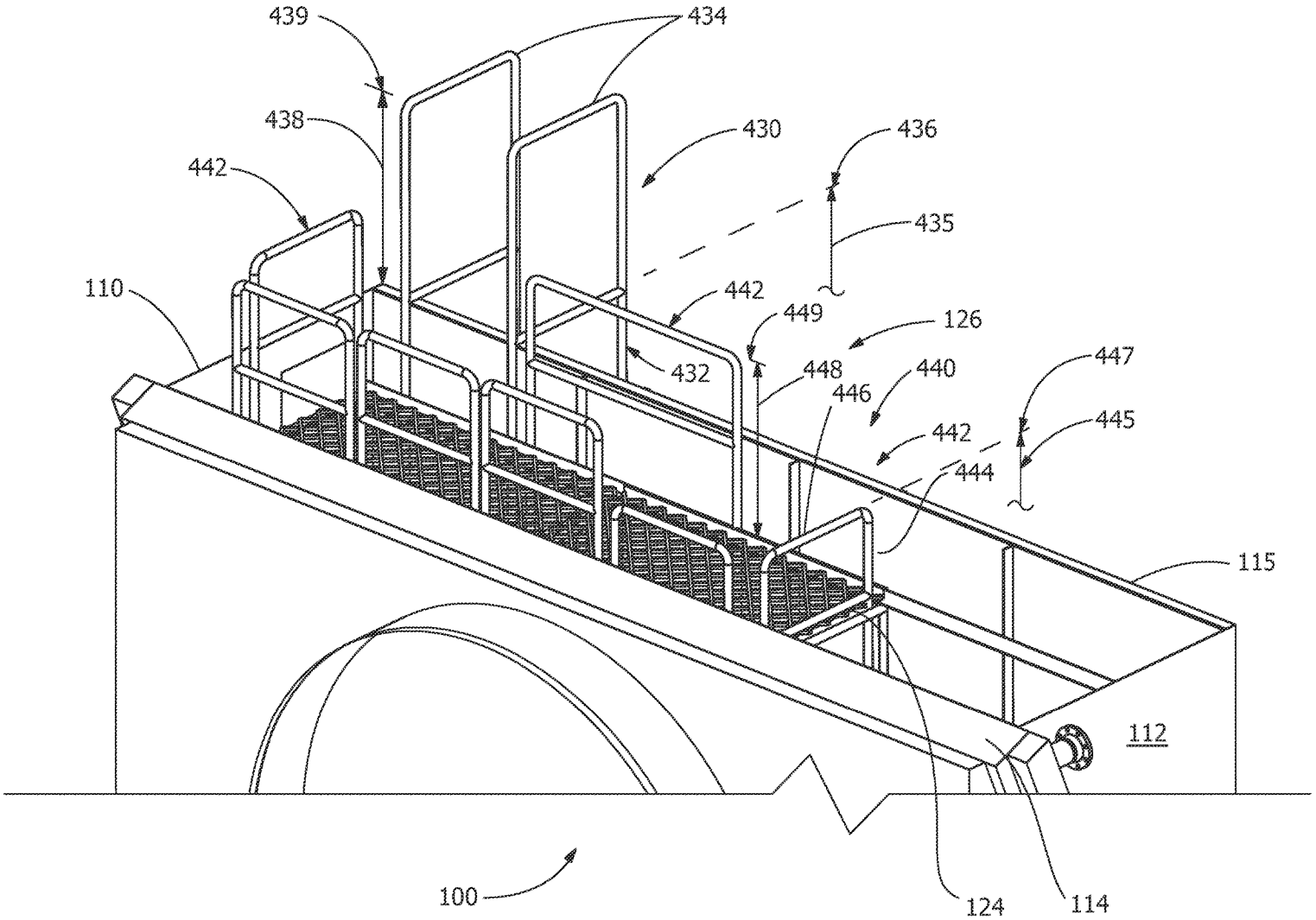
FIG. 5 is a perspective view of an exemplary cooler showing a cooler platform, a vertical wall, a sloping wall, an adjustable handrail, and adjustable ladder according to the disclosure.

Referring to FIG. 5, in one embodiment, the cooler 100 includes another embodiment of the cooler platform assembly 126. The cooler platform assembly 126 includes a ladder 430, (for example, a fixed ladder, a removable ladder, an extendible ladder, or a collapsible ladder). The ladder 430 includes a fixed height portion 432 and an adjustable portion 434. The top elevation of the fixed height portion 432 is at a predetermined height 435 above platform 124, corresponding to a first position 436, for example, for transport. The predetermined height 435 is such as, equal to the height of the vertical wall 115, about equal to the height of the vertical wall 115, or above the height of the vertical wall 115, or any other suitable height elevation. In one embodiment, the predetermined height 435 provides ease in shipping the cooler 100. The adjustable portion 434 extends the ladder height by any suitable mechanism. For example, in one embodiment, the adjustable portion 434 is a separate ladder portion that attaches to the fixed height portion 432, or the adjustable portion 434 is telescoping, or a combination thereof. As the cooler 100 is installed in the field, the adjustable portion 434 is extended, and/or retracted, and/or attached to the fixed height portion 432 to provide at least a predetermined height 438 at a second position 439, for example, for maintenance. The predetermined height 438 of the top of the ladder 430 above the top of the vertical wall 115 is at least such height as to comply with code or safety regulations. In one embodiment, the ladder 430 is a fixed ladder which is assembled and attached to the cooler platform assembly 126 in the field. The ladder 430 includes various features, suitable features include, for example, bracing structure to attach the ladder 430 to the vertical wall 115, an entry platform at the top of the ladder 430, or a safety cage surrounding a portion of the ladder 430 (not shown).

In one embodiment, an adjustable handrail system 440 includes one or more handrail assemblies 442. Each handrail assembly 442 includes a fixed height portion 444 (for example, a bottom) and an adjustable portion 446 (for example, a top). The top elevation of the fixed height portion 444 is at a predetermined height 445, corresponding to a first position 436, for example, for transport. The predetermined height 445 is such as, equal to the height of the vertical wall 115, about equal to the height of the vertical wall 115, or above the height of the vertical wall 115, or any other suitable height elevation. In one embodiment, the predetermined height provides ease in shipping the cooler 100. The adjustable portion 446 extends the handrail assembly height by any suitable mechanism. For example, in one embodiment, the adjustable portion 446 is a separate handrail portion that attaches to the fixed height portion 444. In another embodiment, the adjustable portion 446 is rotatably attached to the fixed height portion 444. In a further embodiment, the adjustable portion 446 is telescoping, or a combination thereof. As the cooler 100 is installed in the field, the adjustable portion 446 is extended, and/or retracted, and/or attached to the fixed height portion 444 to provide at least a predetermined height 448 at a second position 449, for example, for maintenance. The predetermined height 448 of the top of the handrail system 440 above the top surface of the platform 124 is at least such height as to comply with code or safety regulations.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cooler, comprising:

a first wall perpendicular to a fan support wall;

a second wall opposite and parallel to the first wall and adjacent to the fan support wall;

a vertical wall opposite and parallel to said fan support wall and adjacent to the first wall and the second wall, the vertical wall comprising an upper edge, a lower edge, a mid-height horizontal member spanning from the first wall to the second wall, and a plurality of diagonal members extending from the lower edge to the mid-height horizontal member, wherein the fan support wall, vertical wall, first wall and second wall are connected, defining a substantially open-top box of rectangular shape;

a sloped interior section having one or more pipes, the sloped interior section substantially dividing said open-top box into two regions;

a cooling region within the open-top box defined by the fan support wall, the first wall, the second wall, and the sloped interior section, the sloped interior section extending between the first wall and the second wall and sloping downward and away from the fan support wall toward the vertical wall;

a discharge region within the open-top box defined by the first wall the second wall, the sloped interior section, and the vertical wall;

a fan having a rotational axis; and a cooler platform assembly comprising one or more cooler platforms positioned within the discharge region, the one or more cooler platforms having a first end proximal to and over the sloped interior section and a second end proximal to and hingedly attached to the vertical wall, wherein the one or more cooler platforms are retracted substantially perpendicular to the rotational axis of the fan and substantially parallel to the vertical wall and mid-height horizontal member during operation of the cooler thereby reducing airflow restriction, and are deployed substantially perpendicular to the vertical wall and substantially parallel to the rotational axis of the fan and mid-height horizontal member during maintenance of the cooler, one or more vertical members, on the vertical wall exterior, outside the discharge region and extending from the mid-height horizontal member to the upper edge of the vertical wall, one or more internal members, positioned on the vertical wall within the discharge region, substantially extending from the upper edge toward the mid-height horizontal member, and extending along a portion of the vertical members and aligned therewith, one or more platform support members, positioned horizontally on the vertical wall within the discharge region, under the cooler platform, one or more diagonal braces, positioned within the discharge region, extending from the one or more internal members to the cooler platform distal from the vertical wall and proximal to and independent of the sloped interior section, one or more intermediate support members extending from the plurality of diagonal members to the mid-height horizontal member.

2. The cooler of claim 1, wherein the one or more internal members are positioned on the vertical wall within the discharge region between the one or more cooler platforms.

3. The cooler of claim 1, wherein the cooler is a vertical discharge cooler comprising a center and a center of gravity, wherein the sloped interior section is positioned to place the center of gravity proximal to the center of the cooler.

4. The cooler of claim 1, wherein the sloped interior section slopes away from the fan support wall at a predetermined angle, the predetermined angle being greater than or substantially equal to 10 degrees.

5. The cooler of claim 1, wherein the one or more platform support members are positioned horizontally, on the first wall, the second wall and on the vertical, wall within the discharge region under the cooler platform.

6. The cooler of claim 1, wherein the sloped interior section includes flow control features chosen from the group consisting of: adjustable shutters, fixed turning vanes, and a combination thereof.

7. The cooler of claim 1, wherein the cooler has a substantially rectilinear arrangement having a predetermined footprint not being expanded by the one or more cooler platforms.

8. The cooler of claim 1, wherein the one or more cooler platforms are a grate.

9. The cooler of claim 1, wherein at least one of the one or more cooler platforms are solid.

10. The cooler of claim 1, wherein the one or cooler platforms, in the deployed position, are capable of supporting a person.

11. The cooler of claim 1, wherein the one or more cooler platforms provide protection of the sloped interior section during transport of the cooler.

12. The cooler of claim 1, wherein at least one of the one or more diagonal braces extends from the one or more internal members to support the cooler platform distal from the vertical wall and proximal to the sloped interior section, when the one or more cooler platforms are deployed.

13. The cooler of claim 12, wherein the cooler platform and the sloped interior section contact each other when the cooler platform is deployed.

14. The cooler of claim 1, wherein the first end of at least one of the one or more cooler platforms are fixedly secured proximal to the sloped interior section.

15. The cooler of claim 1, wherein the second end of the one or more cooler platforms are secured to the vertical wall by a piano hinge.

16. The cooler of claim 1, wherein the cooler includes a ladder comprising an adjustable portion having a first height configured for transport of the cooler, a second height configured for maintenance of the cooler discharge region.

* * * * *